US011198537B1

(12) United States Patent
Bastian, II

(10) Patent No.: US 11,198,537 B1
(45) Date of Patent: Dec. 14, 2021

(54) PALLET WITH PRINTED IMAGES

(71) Applicant: Artistic Composite Pallets LLC, Indianapolis, IN (US)

(72) Inventor: W. A. Bastian, II, Carmel, IN (US)

(73) Assignee: Artistic Composite Pallets LLC, Indianapolis, IN (US)

( * ) Notice: Subject to any disclaimer, the term of this patent is extended or adjusted under 35 U.S.C. 154(b) by 0 days.

(21) Appl. No.: 15/929,903

(22) Filed: May 28, 2020

(51) Int. Cl.
*B65D 19/38* (2006.01)
*B65D 19/00* (2006.01)

(52) U.S. Cl.
CPC ..... *B65D 19/38* (2013.01); *B65D 19/0008* (2013.01); *B65D 2519/00288* (2013.01); *B65D 2519/00825* (2013.01)

(58) Field of Classification Search
CPC .. B65C 9/00; B65D 2519/00825; B65D 19/38
See application file for complete search history.

(56) References Cited

U.S. PATENT DOCUMENTS 4,927,486 A * 5/1990 Fattal ..... G05B 19/128 156/351
5,216,442 A * 6/1993 Parks ..... B41J 11/0085 346/104
5,327,839 A 7/1994 Herring et al.
5,970,874 A * 10/1999 Bill ..... B41F 16/02 101/115
6,229,556 B1 * 5/2001 Venkataraman ..... B41J 2/32 347/171
6,672,356 B1 * 1/2004 Jenkins ..... B65C 1/021 156/350
7,185,689 B2 * 3/2007 Jenkins ..... B65C 1/021 156/350
7,437,860 B2 * 10/2008 Brandow ..... B65B 19/28 156/363
7,922,857 B2 * 4/2011 Okuno ..... B65C 9/1884 156/247

(Continued)

FOREIGN PATENT DOCUMENTS

JP 2003327280 A 11/2003
KR 10-20190068206 A 6/2019

(Continued)

OTHER PUBLICATIONS

PCT, International Application No. PCT/US2021/070614 Written Opinion, 5 pages, dated Sep. 17, 2021.

(Continued)

*Primary Examiner* — Jose V Chen
(74) *Attorney, Agent, or Firm* — Woodard, Emhardt, Henry, Reeves & Wagner, LLP

(57) ABSTRACT

A system and technique has been developed to print graphics on a pallet. In one form, the graphics are printed on one of the decks of the pallet. The graphics in one variation are printed on a deck that is in the form of a flat, contiguous surface via a flatbed printer. The flatbed printer has a printer head that forms a gap that is able to accommodate the deck of the pallet. After printing, the deck is assembled with the rest of the pallet. The graphics can include text and images. In one form, the graphics include a packing template that shows how at least one packing layer should be packed on the pallet.

33 Claims, 11 Drawing Sheets

(56) References Cited

U.S. PATENT DOCUMENTS

| | | | | |
|---|---|---|---|---|
| 8,528,717 | B2 * | 9/2013 | Ando | B41J 11/06 198/345.3 |
| 8,580,338 | B1 * | 11/2013 | Dronzek, Jr. | G09F 3/20 427/207.1 |
| 9,937,100 | B1 * | 4/2018 | Joplin | G06Q 10/08 |
| 10,046,553 | B2 * | 8/2018 | Hoffman, Jr. | B41M 1/12 |
| 10,450,159 | B2 * | 10/2019 | Dekel | B41J 11/007 |
| 2004/0159266 | A1 | 8/2004 | Fisch et al. | |
| 2005/0193929 | A1 | 9/2005 | Ingham | |
| 2005/0241549 | A1 | 11/2005 | Gordon | |
| 2007/0246398 | A1 * | 10/2007 | Pedler | A47F 5/112 206/745 |
| 2010/0089006 | A1 * | 4/2010 | Salm | B65C 7/00 53/445 |
| 2010/0225721 | A1 | 9/2010 | Crabtree et al. | |
| 2010/0229764 | A1 | 9/2010 | Ingham | |
| 2011/0252986 | A1 * | 10/2011 | Pitzer | B65G 1/18 101/45 |
| 2013/0170928 | A1 * | 7/2013 | Veis | B41J 13/0072 414/222.01 |
| 2014/0026523 | A1 * | 1/2014 | Wilson | B65B 11/004 53/443 |
| 2015/0072097 | A1 * | 3/2015 | Tobol | B31D 1/028 428/41.8 |
| 2016/0114595 | A1 * | 4/2016 | Dunlop | H01L 21/67259 347/110 |

FOREIGN PATENT DOCUMENTS

| | | | | |
|---|---|---|---|---|
| KR | 101988195 | B1 | 6/2019 | |
| WO | 2007123423 | A1 | 11/2007 | |
| WO | WO-2015140731 | A1 * | 9/2015 | C23C 16/56 |
| WO | 2019094460 | A1 | 5/2019 | |

OTHER PUBLICATIONS

PCT, Int'l App. No. PCT/US2021/070614 International Search Report, 3 pages, dated Sep. 17, 2021.

* cited by examiner

PALLET WITH PRINTED IMAGES

BACKGROUND

Pallets are commonly used to store and transport a variety of items. If not packed properly, items can tend to fall off the pallet which can be dangerous. Industrial and warehouse settings tend to not provide an aesthetically appealing environment which tends to harm personnel morale and motivation. When empty and/or not in use, pallets tend to be an eyesore which further diminishes personnel morale.

Thus, there is a need for improvement in this field.

SUMMARY

A unique system and technique have been developed for printing images, text, decorations, or other designs on a functional pallet. Traditional wooden slat pallets have been hand painted with various designs, such as flag patterns, but these pallets were intended to be non-functional and merely decorative in nature. Moreover, the image quality was rather poor and not suitable for commercial use. The paint on these pallets tend to wear and fade rather easily such that the image would not survive typical pallet usage patterns. The unique printing technique and pallet design addresses these as well as other issues.

Rather than being formed from slats that are spaced from one another, the top and/or bottom decks of the pallets according to this unique system and technique are generally contiguous to form a continuous surface for printing the images. In one example, only the top deck is contiguous while the bottom deck is not (e.g., has pallet jack openings). In one version, the images are printed via a flatbed printer on a medium density fiberboard (MDF) type surfaces that form the top and/or bottom decks of the pallet. In one specific example, the printing is applied to a composite top board with a polyurea coating (generally a bright white, light sand finish). In this example, the polyurea is applied to 3 mm MDF which is the "sandwich" substrate of the top board. In one form, the finish on the MDF is a sand type finish. The deck typically, but not always, has a sand finish or a flat matte finish. The image is normally printed on a white background, but other background colors can be used in other examples.

The printers are configured to accommodate the depth or height of the pallets during printing. An ultraviolet (UV) printer is used to print the images on the decks of pallets in one example. The UV inks' chemical bond to the pallet and wear characteristic make them suitable for use with pallets that are commercially used to store and transport items. In one particular example, a UV flatbed printer with the depth capability to handle at least a one inch (1") top board is used. In another version, a latex type printer is used to print images on the top deck of a pallet. In one form, a latex or vinyl matte finish is printed. The images for instance can include advertising materials, images of art (e.g., paintings), phot-realistic image, quotes, and/or instructions on how to handle the pallet, just to name a few examples. In one variation, the image provides instructions for handholds on the pallet. In one particular example, the image includes a shadow box image of where the boxes or other items should be placed when building a pallet layer.

The system and techniques as described and illustrated herein concern a number of unique and inventive aspects. Some, but by no means all, of these unique aspects are summarized below.

Aspect 1 generally concerns a system that includes pallet with one or more printed images.

Aspect 2 generally concerns the system of any previous aspect in which the images are printed on at least one deck of the pallet.

Aspect 3 generally concerns the system of any previous aspect in which the deck has a contiguous flat surface.

Aspect 4 generally concerns the system of any previous aspect in which the deck includes medium density fiberboard (MDF).

Aspect 5 generally concerns the system of any previous aspect in which the deck has a sand finish.

Aspect 6 generally concerns the system of any previous aspect in which the deck has a matte finish.

Aspect 7 generally concerns the system of any previous aspect in which the deck has a vinyl finish.

Aspect 8 generally concerns the system of any previous aspect in which the deck includes a load deck.

Aspect 9 generally concerns the system of any previous aspect in which the images are printed with a flatbed printer.

Aspect 10 generally concerns the system of any previous aspect in which the printer has a printer head spaced to accommodate the thickness of the deck.

Aspect 11 generally concerns the system of any previous aspect in which the images are printed via a latex printer.

Aspect 12 generally concerns the system of any previous aspect in which the images are printed via an ultraviolet (UV) printer.

Aspect 13 generally concerns the system of any previous aspect in which the images include advertisements.

Aspect 14 generally concerns the system of any previous aspect in which the images include text.

Aspect 15 generally concerns the system of any previous aspect in which the text includes quotes.

Aspect 16 generally concerns the system of any previous aspect in which the text includes instructions.

Aspect 17 generally concerns the system of any previous aspect in which the images include decorations.

Aspect 18 generally concerns the system of any previous aspect in which the images include a packing template for at least one packing layer of the pallet.

Aspect 19 generally concerns a system that includes deck is assembled with a spacer structure of the pallet after the printing.

Aspect 20 generally concerns a method of operating the system of any previous aspect.

Further forms, objects, features, aspects, benefits, advantages, and embodiments of the present invention will become apparent from a detailed description and drawings provided herewith.

DETAILED DESCRIPTION OF SELECTED EMBODIMENTS

Figure 1:
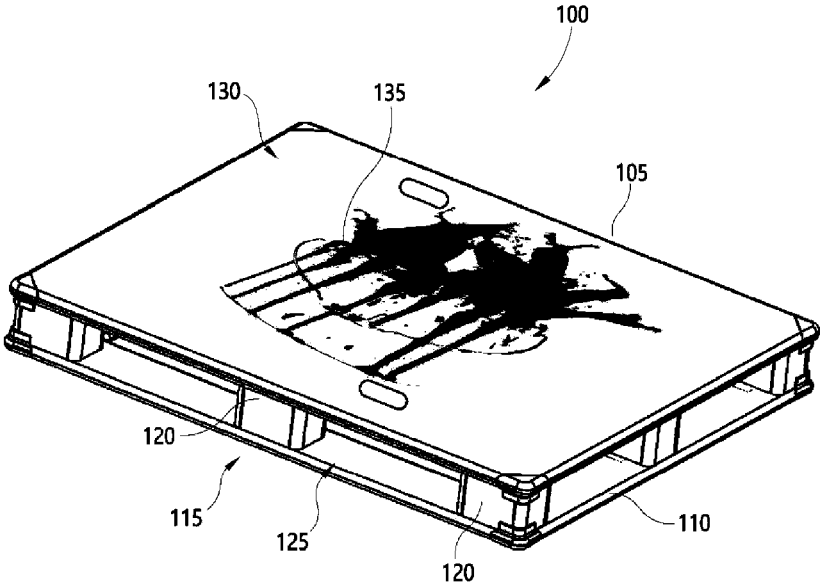
FIG. 1 is a perspective view of a pallet with an image according to one example.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

The reference numerals in the following description have been organized to aid the reader in quickly identifying the drawings where various components are first shown. In particular, the drawing in which an element first appears is typically indicated by the left-most digit(s) in the corresponding reference number. For example, an element identified by a "100" series reference numeral will likely first appear in FIG. 1, an element identified by a "200" series reference numeral will likely first appear in FIG. 2, and so on.

Figure 2:
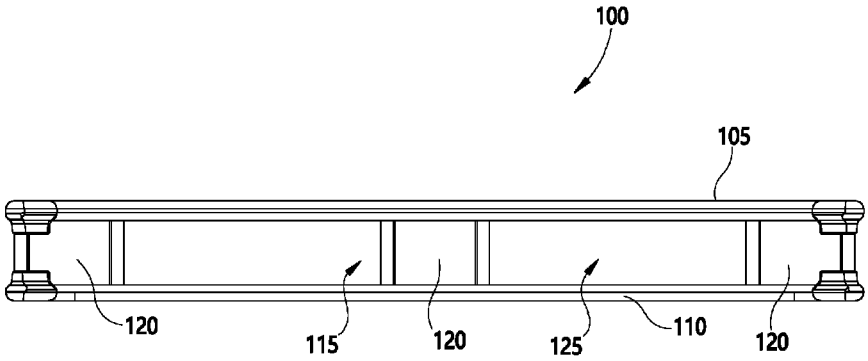
FIG. 2 is a side view of the FIG. 1 pallet.

A unique pallet and pallet printing system has been developed for printing graphics, such as images and text, on the pallet. These graphics for example can be used to provide instructions to those packing, handling, and/or unpacking the pallet as well as provide advertising space that can be used to offset some of the costs associated with the pallet. FIG. 1 is a perspective view of a pallet 100 according to one example. FIG. 2 is a side view of the FIG. 1 pallet 100.

The pallet 100 is a portable platform or other structure on which goods or other items can be stacked, stored, and/or transported. The pallet 100 includes a load deck 105, a support deck 110, and a spacer structure 115 that connects the load deck 105 and the support deck 110 together. In the illustrated example, the load deck 105 provides a flat surface on which items are packed. Typically, but not always, the support deck 110 sits against the floor and/or ground. The spacer structure 115 spaces apart the load deck 105 and the support deck 110. The spacer structure 115 includes one or more spacer blocks 120 attaching the load deck 105 to the support deck 110 such as via fasteners, adhesives, and/or in other manners. The spacer blocks 120 define one or more fork openings 125 where forks from forklifts or pallet jacks are received to lift the pallet 100. All or part of the pallet 100 is made of a composite material. In one form, at least the load deck 105 and support deck 110 are made of an Engineered Cementitious Composite (ECC) material. All or part of the pallet 100 in other examples can be made of other materials such as metal, plastic, and/or wood.

As shown, one or more images 130 are printed on the load deck 105. In other variations, the images 130 are printed on the support deck 110, or on both the load deck 105 and the support deck 110. Unlike traditional slat type pallets, which have boards that form discontinuous decks, the load deck 105 in the illustrated pallet 100 forms a continuous flat surface. With this unitary, flat construction of the load deck 105, the images 130 printed on the load deck 105 are able to have a high quality or even photorealistic quality. This ability to have high quality images 130 allows the pallet 100 to be leveraged for use in other scenarios besides the normal material handling function of pallets. For example, the images 130 on the pallet 100 can be used for advertisements both internal to the business and externally. One or more of the pallets 100 can be flipped on their sides to form virtual billboards for advertising such as when not in use. For example, the pallets 100 can be used to transport equipment for entertainers (e.g., bands) or sports team, and during the event or game when the equipment is off the pallets 100, the pallets 100 can be used to provide advertising space such as along the perimeter of the playing field or concert venue.

The images 130 on the pallets 100 can also be used to enhance the work environment of personnel handling or working in the vicinity of the pallets 100. The images 130 on the pallets 100 for example can provide instructions or safety information related packing, unpacking, and/or handling the pallets 100 or items packed on the pallets 100. The images 130 can further include quotes or slogans to enhance the morale of personnel. As anyone who has worked in a manufacturing or warehouse environment would know, such places have a hard industrial feel. In certain examples, the images 130 on the pallets 100 can include aesthetically pleasing pictures, designs, photographs, and/or other artwork to enhance the aesthetical setting of the work environment. In the illustrated example, the images 130 include at least one color image 135, and more specifically, the color image 135 includes a photorealistic image or photograph of a paint bucket with splashes of various bright paint colors. It should nevertheless should be recognized that the images 130 can include other types of images. As will be explained below, the images 130 have been printed on the pallets 100 in such a way so as to handle the harsh working environments that the pallets 100 normally experience.

Figure 3:
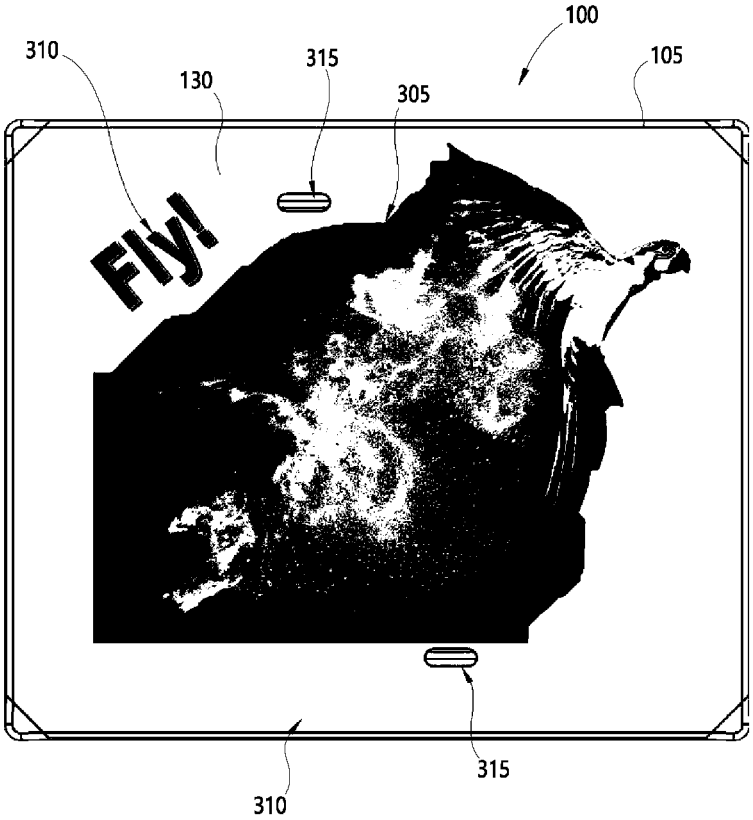
FIG. 3 is a top view of the FIG. 1 pallet with a different image.

One specific use case example is shown in FIG. 3. As depicted, the images 130 include an image section 305 and a text section 310, but the images 130 can be configured differently in other examples. The image section 305 includes an image such as a photorealistic picture, painting, and/or photograph. In the depicted example, the image section 305 includes a color image of a parrot, but other types of images can be used in other examples. The text section 310 includes human readable text. The text section 310 can for instance can include a phrase, quote, and/or slogan. The text section 310 in other examples includes other types of text such as for providing instructions on how to pack, handle, and/or unpack the pallet 100.

Unlike pallets that utilize slats or boards to form the decks, the load deck 105 in the pallet 100 again generally provides a continuous (or contiguous) surface on which the images 130 are printed. It should be recognized that only the areas on the decks on which the images 130 are printed need to be continuous to provide a smooth and uniform surface to provide high quality images 130. For example, the load deck 105 can further optionally include one or more hand openings 315 where an individual can grasp the pallet 100 that is located outside of the desired printing area.

Figure 4:
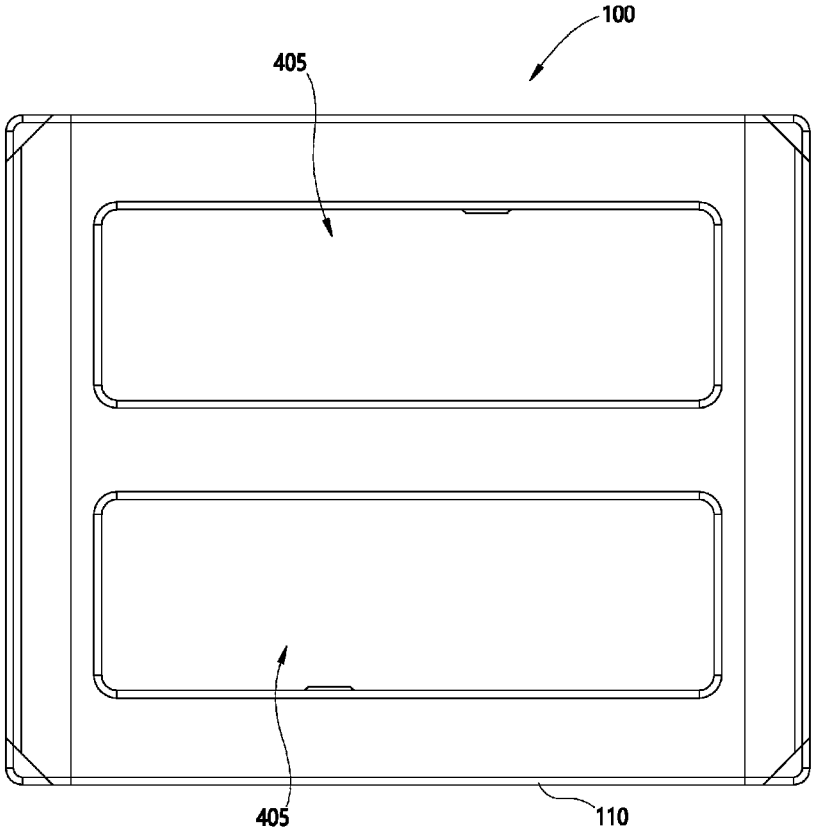
FIG. 4 is a bottom view of the FIG. 1 pallet.

Looking at FIG. 4, the support deck 110 has one or more pallet jack openings 405 where pallet jacks are able to engage the floor in order to lift the pallet 100. In other examples, the support deck 110 does not include the pallet jack openings 405. For instances, like the load deck 105, the support deck 110 in other variations has a continuous surface on which the images 130 are printed.

Figure 5:
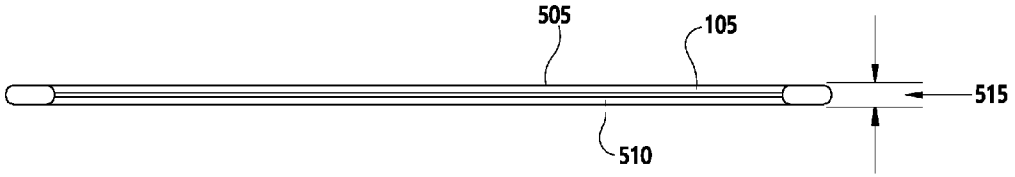
FIG. 5 is a side view of a load deck in the FIG. 1 pallet.

The load deck 105 and support deck 110 in one example are made of a composite material. In one version, the load deck 105 and support deck 110 include a medium density fiber board (MDF) material coated with various materials such as a composite material with a polyurea coating. The MDF in one form has a 3 mm thickness and forms a sandwich arrangement within the load deck 105. As illustrated in FIG. 5, the load deck 105 has an exterior surface 505 and an interior surface 510 located opposite the exterior surface 505. The images 130 are printed on the exterior surface 505, and when the pallet 100 is assembled, the interior surface 510 faces the fork openings 125. In one form, at least the exterior surface 505 of the load deck 105 has a sand finish to enhance grip. In other variations, the exterior surface 505 can have a sand or matte finish. At least, the exterior surface 505 has a color and/or shade suitable for printing so that the images 130 are visible. For instance, the exterior surface 505 in one example is white so as to provide a white background for the images 130. In other examples, the exterior surface 505 can have a light shade/color and/or have a contrasting shade/color as compared to the images 130. Alternatively or additionally, the interior surface 510 can be configured in a similar fashion so that the images 130 are printed on the interior surface 510 of the load deck 105 (and/or support deck 110). In such a case, the images 130 are visible when viewed through the pallet jack openings 405 in the support deck 110.

The load deck 105 has a thickness 515 as measured from the exterior surface 505 to the interior surface 510. In one form, the thickness 515 of the load deck 105 (and the support deck 110) is at most 1 inch (2.54 cm) thick. The thickness 515 of the load deck 105 is sized so that load deck 105 of the pallet 100 is able support most common loads. At the same time, the thickness 515 of the load deck 105 allows the images 130 to be readily printed on the load deck 105 using a flatbed printer.

Figure 6:
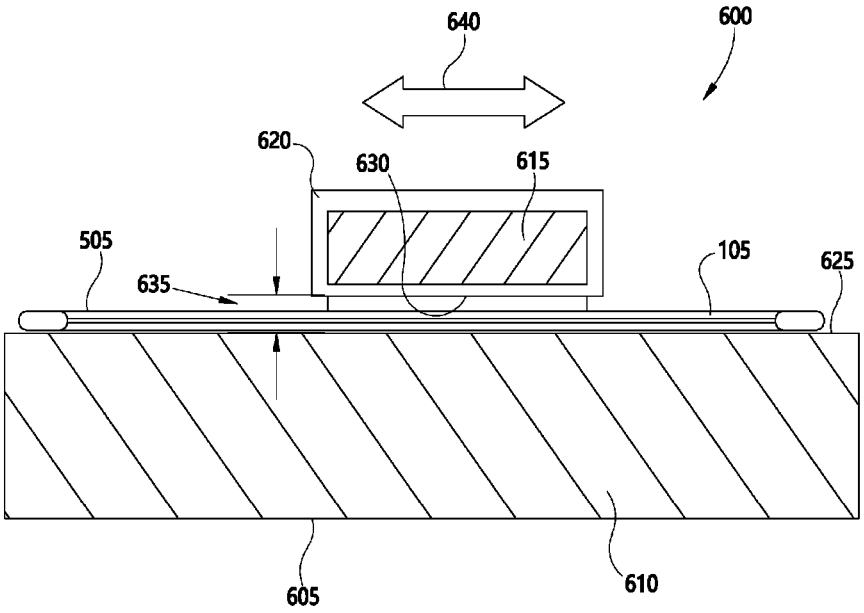
FIG. 6 is a partial cross-sectional view of a system where one or more images are printed on the FIG. 5 load deck.
Figure 7:
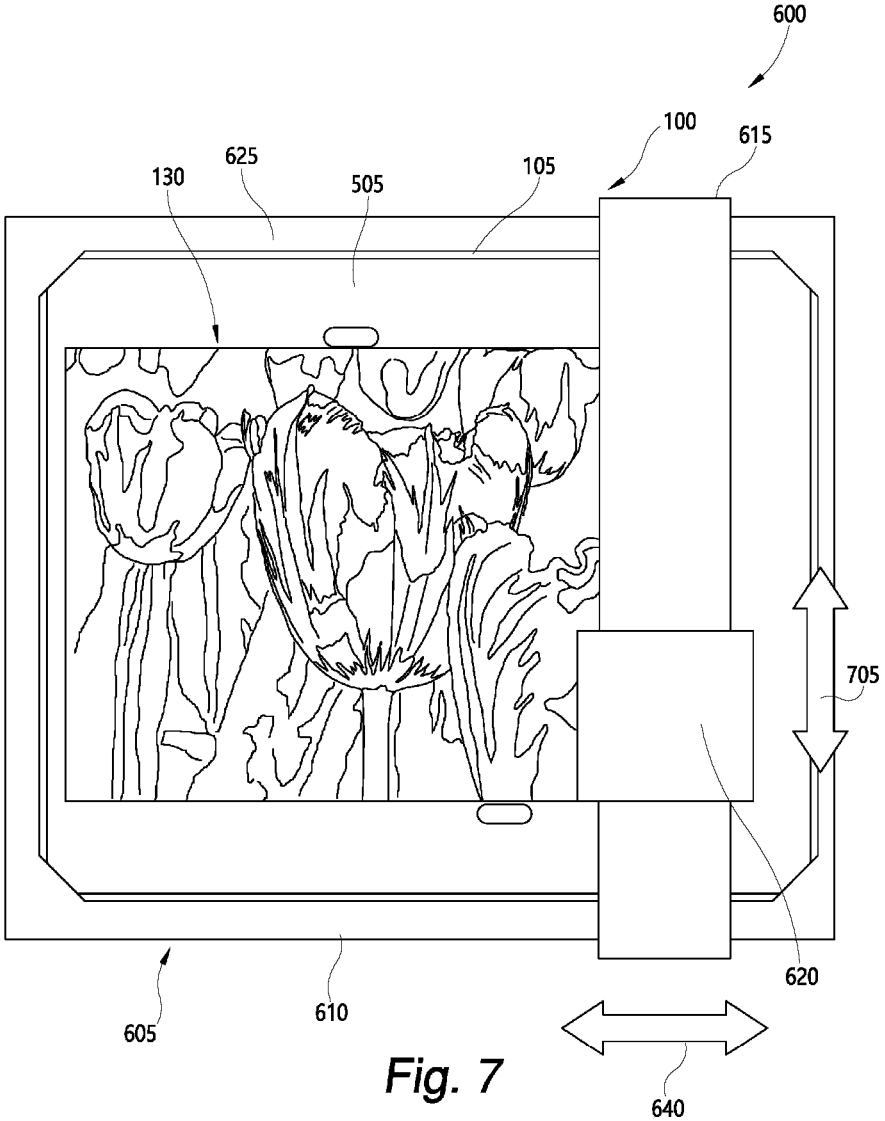
FIG. 7 is a top view of the FIG. 6 system.

Referring to FIGS. 6 and 7, a system 600 for printing the images 130 on the exterior surface 505 of the load deck 105 includes a flatbed printer 605. It should be recognized that the flatbed printer 605 can also be used to print the images 130 on the interior surface 510 of the load deck 105 or on either side of the support deck 110. In one form, the flatbed printer 605 includes an ultraviolet (UV) flatbed printer, and in another form, the flatbed printer 605 includes a latex flatbed printer.

The flatbed printer 605 includes a bed 610, a printer head gantry 615, and a printer head 620 that moves along the printer head gantry 615. The printer head 620 is configured to print the images 130 on the exterior surface 505 of the load deck 105. The bed 610 has a bed surface 625 where the load deck 105 rests during printing. In the illustrated example, the bed surface 625 generally is flat.

The printer head 620 is spaced from the bed surface 625 so as to provide sufficient clearance for accommodating the load deck 105 so that the printer head 620 able to move and print the images 130 on the load deck 105. As shown, the printer head 620 has a printer head face 630 that faces the bed surface 625. The printer head face 630 defines a printer head gap 635 above the bed surface 625. The printer head gap 635 is larger than the thickness 515 of the load deck 105 so that the flatbed printer 605 is able to print the images 130 on the exterior surface 505 of the load deck 105. In one form, the printer head gap 635 is greater than 1 inch (2.54 cm).

With the printer head gap 635, the flatbed printer 605 is able to move and print on the entire desired printing area of the load deck 105. For example, the printer head gantry 615 is configured to move along the bed 610 in a longitudinal direction 640. The printer head 620 is configured to move in a lateral direction 705 along the printer head gantry 615 to print the images 130 on the exterior surface 505 of the load deck 105.

A technique for printing the images 130 on the pallet 100 and assembling the pallet 100 will now be described with reference to the flowchart 800 in FIG. 8. This technique will be described with reference to printing the images 130 on the load deck 105, but it should be recognized that this technique can be used to print the images 130 on the support deck 110 alone, or on both the load deck 105 and the support deck 110. In stage 805, the load deck 105 is manufactured. In one form, the load deck 105 is created from a composite material. In one variation, 3 mm MDF is applied on both the exterior surface 505 and interior surface 510 of the load deck 105 so as to form a sandwich relationship. The MDF aids in providing a smooth, flat background or substrate on which the images 130 are printed. Simultaneously or sequentially, the support deck 110 can be created in a similar fashion.

In stage 810, the background for the images 130 is created on the load deck 105. Once more, the background for the images 130 is generally selected to enhance contrast and/or improve image quality. For instance, at least the area of the load deck 105 where the images 130 are printed has a white or light color in one form. A polyurea coating is applied to the MDF in one example. Sand can be applied to the exterior surface 505 of the load deck 105 so as to enhance grip. Alternatively, the load deck 105 can have a matte finish.

Figure 8:
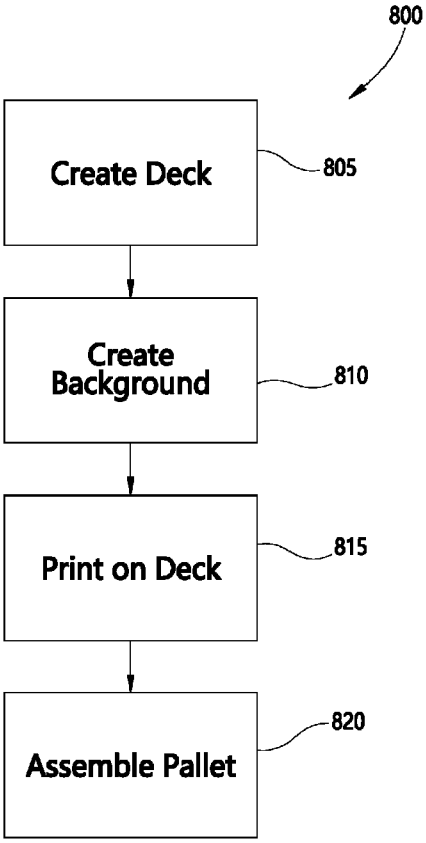
FIG. 8 is a flowchart of a method for manufacturing the FIG. 1 pallet.

Referring to FIGS. 6, 7, and 8, the load deck 105 in stage 815 is loaded onto the bed 610 of the flatbed printer 605 with the exterior surface 505 of the load deck 105 facing the printer head 620. As noted before, the printer head gap 635 of the flatbed printer 605 provides sufficient clearance to accommodate the thickness 515 of the load deck 105. In one form, the flatbed printer 605 is a UV flatbed printer. It was discovered that the images 130 produced with the UV flatbed printer provided superior wear properties such that the images 130 were able to survive the typical wear patterns experienced during normal commercial use of the pallet 100. Alternatively or additionally, a latex or vinyl matte finish is printed. The images 130 can be cured or dried during the printing process on the flatbed printer 605, or the load deck 105 can be removed from the flatbed printer 605 for curing or drying of the images 130 printed on the load deck 105.

Having the images 130 printed on the load deck 105 separately from the rest of the pallet 100 allows the images 130 to be printed using the flatbed printer 605. Once the images 130 are printed and properly cured or dried, the load deck 105 in stage 820 is then assembled with the rest of the pallet 100. In one example, the spacer blocks 120 of the spacer structure 115 are attached to the load deck 105, such as via fasteners and/or adhesive, and then the spacer structure 115 is attached to the support deck 110. In another variation, the spacer blocks 120 of the spacer structure 115 are first attached to or integrally formed with the support deck 110, and afterwards, the load deck 105 is attached to the spacer blocks 120. This variation allows the assembly of the support deck 110 and spacer structure 115 to occur during the printing in stage 815 which in turn reduces production time. It should be recognized that the pallet 100 can be assembled in other manners in stage 820.

Figure 9:
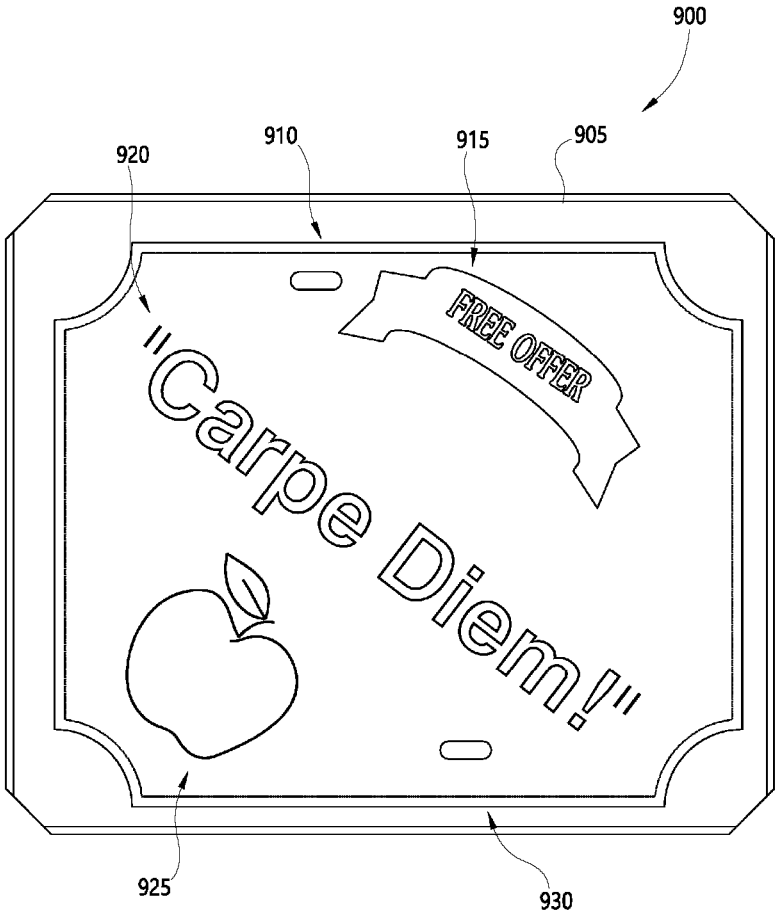
FIG. 9 is a top view of a pallet according to another example.

It should be recognized that the images 130 on the pallet 100 can include other graphical types and/or information. For example, as illustrated in FIG. 9, a pallet 900 according to another example includes a load deck 905. The pallet 900 in FIG. 9 is constructed in a fashion similar to the pallet 100 in FIG. For the sake of brevity and clarity, these common features will not be discussed in greater detail, so please refer to the previous discussion. The load deck 905 includes one or more graphics 910. As shown, the graphics 910 include one or more advertisements 915, one or more quotes 920, one or more graphics 925, and one or more decorations 930. Through the advertisements 915, the pallet owner is able to advertise any number of goods or services. Again, the pallet 900 can be tilted on its side when not in use to function like a sign or billboard. The overall graphical image can span across multiple pallets to form a large image when the pallets 900 are placed in close proximity to one another. The quotes 920 can be used for motivational or even educational purposes. The graphics 925 and decorations 930 can be used to enhance the aesthetical environment for those viewing the pallet 900. For instance, the graphics 925 can include a piece of artwork.

Figure 10:
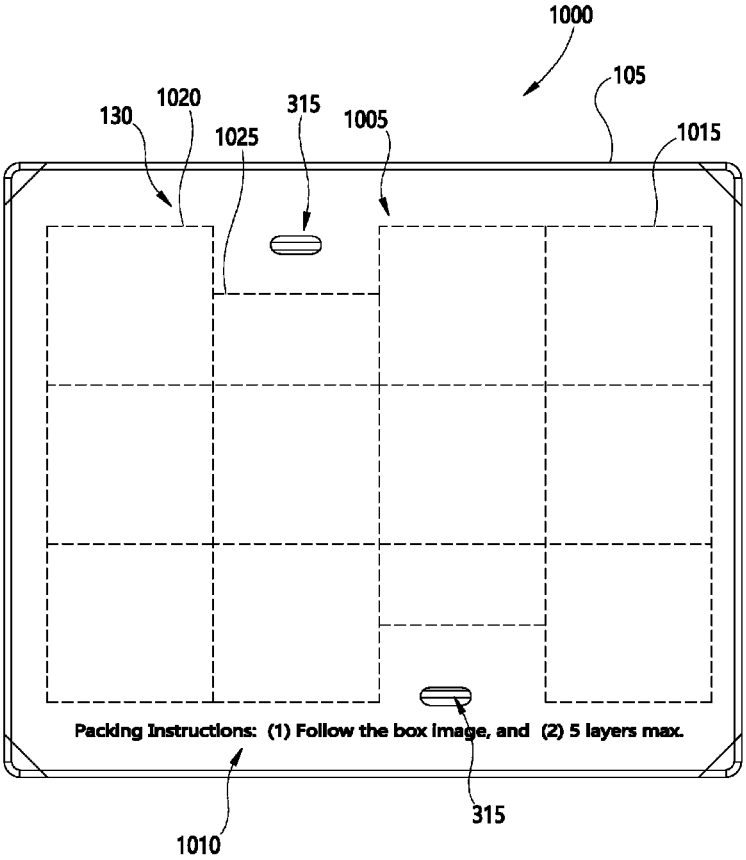
FIG. 10 is a top view of a pallet according to a further example.

FIG. 10 shows a top view of a pallet 1000 according to another example. The pallet 1000 in FIG. 10 is constructed in a fashion similar to the FIG. 1 pallet 100 and the FIG. 9 pallet 900. As an example, the pallet 1000 has the load deck 105 with the images 130. For the sake of brevity and clarity, these common features will not be discussed in greater detail, so please refer to the previous discussion.

The images 130 in the illustrated example includes a graphics section 1005 and a text section 1010. The graphics section 1005 in the illustrated variation includes a packing template 1015 (or shadow box). In the depicted example, the packing template 1015 has one or more first package type markers 1020 and one or more second package type markers 1025 that show how differently sized (and/or shaped) boxes and/or other items should be packed on the pallet 1000. In the illustrated example, the first package type markers 1020 are larger than the second package type markers 1025. In another example, the first package type markers 1020 are shaped differently than the second package type markers 1025. While the packing template 1015 will be described below as providing a template for packing boxes on the pallet 1000, it should be recognized that the packing template 1015 can be used to provide instructions for packing items with other shapes, such as barrels, bags, sacks, and drums, to name just a few. The packing template 1015 can be used to provide the packing layout of items on the first packing layer or for multiple packing layers. The packing template 1015 in other examples can have more or less package type markers than is shown, and the package type markers can be configured differently than is show. For instance, the packing template 1015 can have a uniform pattern in which in which items have the same dimensions and shape form a uniform packing structure. In other examples, the packing template 1015 includes more than two package type markers that are arranged in a non-uniform pattern.

Figure 11:
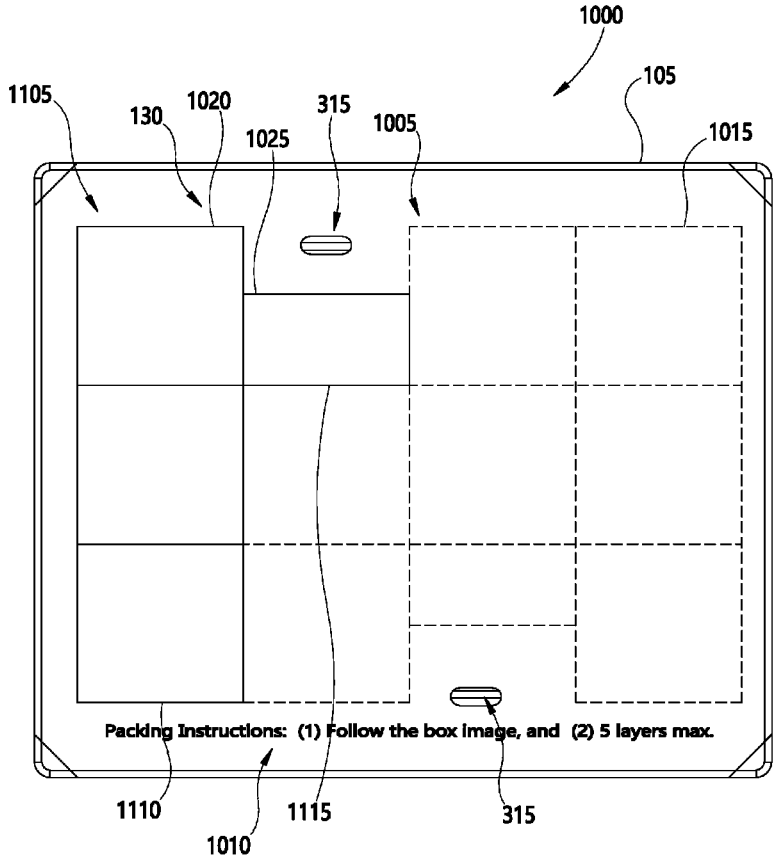
FIG. 11 is a top view of the FIG. 10 pallet with a graphics section partially packed on the load deck.

As mentioned before, the packing template 1015 helps to guide personnel in properly packing the pallet 1000. The instructions provided by the text section 1010 in conjunction with the packing template 1015 can further aid in packing, unpacking, and/or transporting the pallet 1000. Turning to FIG. 11, a packing layer 1105 is formed by matching the pattern of the packing template 1015. In the illustrated example, the packing layer 1105 includes one or more first boxes 1110 and one or more second boxes 1115. The first boxes 1110 are placed at the first package type markers 1020. The second boxes 1115 are placed at the second package type markers 1025. It should be recognized that the same pattern can be used to pack other layers. Alternatively or additionally, the images 130 can include other packing templates superimposed (e.g., with a different color) over the packing template 1015 that indicate the packing pattern for other packing levels and/or differently shaped objects (e.g., drums).

Glossary of Terms

The language used in the claims and specification is to only have its plain and ordinary meaning, except as explicitly defined below. The words in these definitions are to only have their plain and ordinary meaning. Such plain and ordinary meaning is inclusive of all consistent dictionary definitions from the most recently published Webster's dictionaries and Random House dictionaries. As used in the specification and claims, the following definitions apply to these terms and common variations thereof identified below.

"Contiguous" means adjacent or side by side.

"Continuous" generally refers to something marked by uninterrupted extension in space, time, and/or sequence. For example, a continuous line or surface has no gaps and/or holes in it. In other words, something that is continuous is unbroken.

"Engineered Cementitious Composite" (ECC), also known as "bendable concrete" or "Engineered Cementitious Concrete", generally refers to a type of concrete composite material that is reinforced with short random polymer fibers, such as polyvinylalcohol (PVA) fibers. These polymer fibers may be used in a low volume fraction, such as 2-3% by volume, in a concrete mixture to create a concrete matrix with greater tensile strain capacities than a traditional concrete mixture. In other words, ECC is one specific species of Fiber Reinforced Concrete (FRC) that uses polymer fibers so as to provide superior qualities. Unlike regular concrete, ECC has a strain capacity in the range of 3-7%, compared to 0.1% for Ordinary Portland Cement (OPC). ECC therefore acts more like a ductile metal than a brittle concrete (as does OPC). Tests done on ECC material have shown a higher relative strength in tension, greater resistance to catastrophic fatigue cracking, increased durability under reversed loading, and greater dynamic tensile loading capability under projectile impact. More specifically, in some cases, the tensile strain capacity may be approximately 500 times greater than that of standard concrete aggregate mixtures. In one example, the polymer fibers in the concrete mixture are selected to optimize the concrete matrix for the highest tensile strain capacity. PVA fibers are often selected due to the high chemical bonds between the PVA fiber and the concrete and/or the appropriate frictional stresses at this interface. If the interaction between the fibers and the concrete mixture is too strong, the fibers will not stretch properly and the supporting concrete matrix may rupture. In one embodiment, the strength of the interaction between the fibers and the concrete mixture is in a selected range such that when micro cracks form, they will propagate to other locations in the concrete matrix, thus causing strain hardening in the macro level of the ECC material. There are a number of different varieties of ECC.

"Fastener" generally refers to a hardware device that mechanically joins or otherwise affixes two or more objects together. By way of nonlimiting examples, the fastener can include bolts, dowels, nails, nuts, pegs, pins, rivets, screws, and snap fasteners, to just name a few.

"Flat" generally refers to an object having a broad level surface but with little height.

"Flatbed Printer" generally refers to a machine that is used to transfer text and/or images onto relatively flat surfaces and/or substrates. The flatbed printer can include flatbed screen type printers, flatbed laser type printers, and flatbed inkjet type printers. Flatbed inkjet printers can be subcategorized based on the type of ink printed and/or how the printed ink is cured and/or dried. For example, flatbed inkjet printers can be subcategorized into flatbed ultraviolet (UV) printers and flatbed eco-solvent type printers. Flatbed UV printers use an ink that is rapidly cured on the printing surface using UV light. With eco-solvent type flatbed inkjet printers, the ink is typically dried on the printing surface through evaporation of solvents in the ink. An example of such an eco-solvent type printer includes a flatbed latex printer that uses latex type ink with a water solvent. Typically, but not always, the flatbed printer includes a bed that provides a relatively flat surface on which the printing substrate rests. The flatbed printer further includes an arm or gantry that is able to move along the bed during printing. The gantry supports one or more printer heads that spray or otherwise deposit ink on the printing surface. UV printers typically further include a UV light source, such as a UV light emitting diode (LED), that cures the UV ink printed on the printing surface or substrate.

"Graphics" generally refers to a visual representation produced on a surface. The visual representation can for example be of an object, scene, person, and/or abstraction.

"Image" generally refers to one or more visual representations and/or designs on some surface. The image can be functional and/or artistic in nature. Some non-limiting examples of images include photographs, drawings, line art, graphs, diagrams, typography, numbers, text, symbols, geometric designs, maps, engineering drawings, and/or other graphics. Images often (but not always) combine text, illustration, and color. Design of the images may for example include the deliberate selection, creation, and/or arrangement of typography alone, as in a brochure, flyer, poster, web site, and/or book without any other element.

"Integrally Formed" means here to be formed as or fused into a single piece without needing some form of connection or attachment.

"Lateral" generally refers to being situated on, directed toward, or coming from the side.

"Load Deck" generally refers to one or more panels and/or assemblies of boards that form a face of a pallet on which goods and/or other items are carried. For examples, when boxes are stacked on a pallet, the first layer of boxes typically rests on the load deck of the pallet. Typically, but not always, the load deck is located on a side of the pallet that is opposite the support deck.

"Longitudinal" generally refers to the length or lengthwise dimension of an object, rather than across.

"Medium Density Fiberboard" or "MDF" generally refers to a material made of small pieces of wood pressed together to form boards.

"Packing Template" generally refers to a pattern on a surface that guides where one or more items should be placed on a surface to form one or more layers of packed items.

"Pallet" generally refers to a portable platform or other structure on which goods or items can be assembled, stacked, stored, packaged, handled, transported, and/or moved, such as with the aid of a forklift or pallet jack, as a unit load. Typically, but not always, the pallet is rigid and forms a horizontal base upon which the items rest. Goods, shipping containers, and other items are often placed on a pallet secured with strapping, stretch wrap, and/or shrink wrap. Often, but not always, the pallet is equipped with a superstructure. In one form, the pallet includes structures that support goods in a stable fashion while being lifted by a forklift, pallet jack, front loader, and/or other lifting devices. In particular, pallets typically include a top, load deck upon which items are stacked, a bottom, support deck that rests on the ground, and a spacer structure positioned between the load and support decks to receive the forks of the forklift or pallet jack. However, the pallets can be configured differently. For example, the term pallet is used in a broader sense to include skids that have no support deck. One or more components of the pallet, or even the entire pallet, can be integrally formed together to form a single unit. By way of non-limiting examples, these pallets can include stringer, block, perimeter, skid, solid deck, multiple deck board, panel-deck, slave, double-deck (or face), single-way entry, two-way entry, four-way entry, flush, single-wing, double-wing, expendable, limited-use, multiple-use, returnable, recycled, heat treated, reversible, non-reversible, and/or warehouse type pallets.

"Spacer Structure" generally refers to any component, part, object, device, and/or assembly that separates the load deck from an object on which the pallet rests, such as the ground, floor, other pallet, and/or other unit load. By way of nonlimiting examples, the spacer structure can include one or more blocks, stringers, and/or other spacers. Typically, but not always, the spacer structure defines one or more fork entries that each form an entry for admitting one or more forks of a forklift or pallet jack. The fork entry can for instance be formed by the space created between the load and support decks by stringers and/or blocks as well as one or more notches in the stringers or other parts of the pallet to name just a few examples. In one form, the fork entries can be located on opposite ends of the pallet to create a two-way entry pallet, and in another form, the fork entries can be located on both opposite ends and opposite sides of the pallet to create a four-way entry pallet. In other examples, the spacer structure can include more or less, and even none, fork entries.

"Stock Keeping Unit" (SKU) or "Item" generally refers to an individual article or thing. The SKU can come in any form and can be packaged or unpackaged. For instance, SKUs can be packaged in cases, cartons, bags, drums, containers, bottles, cans, pallets, and/or sacks, to name just a few examples. The SKU is not limited to a particular state of matter such that the item can normally have a solid, liquid, and/or gaseous form for example.

"Support Deck" generally refers to one or more panels and/or assemblies of boards that form a face of a pallet that typically (but not always) rests against another object, such as the floor, ground, other pallet, and/or other unit load, to carry the weight of the pallet and any load packed on the pallet. Typically, but not always, the support deck is located on a side of the pallet that is opposite the load deck. The support deck usually, but not always, includes one or more jack openings that allow pallet jack wheels to engage the floor and/or ground on which the support deck rests.

"Template" generally refers to a gauge, pattern, and/or mold (e.g., in a thin plate) used as a guide to form of a piece and/or structure being made.

"Text" generally refers to one or more letters or similar symbols that form words to provide information.

"Thickness" generally refers to the measure of the distance between opposite sides of an object. As used here, the thickness of an object that is positioned between two surfaces is measured from between the two sides of the object that contact the surfaces.

It should be noted that the singular forms "a," "an," "the," and the like as used in the description and/or the claims include the plural forms unless expressly discussed otherwise. For example, if the specification and/or claims refer to "a device" or "the device", it includes one or more of such devices.

It should be noted that directional terms, such as "up," "down," "top," "bottom," "lateral," "longitudinal," "radial," "circumferential," "horizontal," "vertical," etc., are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by the following claims are desired to be protected. All publications, patents, and patent applications cited in this specification are herein incorporated by reference as if each individual publication, patent, or patent application were specifically and individually indicated to be incorporated by reference and set forth in its entirety herein.

REFERENCE NUMBERS

100 pallet
105 load deck
110 support deck
115 spacer structure
120 spacer blocks
125 fork openings
130 images
135 color image
305 image section
310 text section
315 hand openings
405 pallet jack openings
505 exterior surface
510 interior surface
515 thickness
600 system
605 flatbed printer
610 bed
615 printer head gantry
620 printer head
625 bed surface
630 printer head face
635 printer head gap
640 longitudinal direction
705 lateral direction
800 flowchart
805 stage
810 stage
815 stage
820 stage
900 pallet
905 load deck
910 graphics
915 advertisements
920 quotes
925 graphics
930 decorations
1000 pallet
1005 graphics section
1010 text section
1015 packing template
1020 first package type markers
1025 second package type markers
1105 packing layer
1110 first boxes
1115 second boxes

What is claimed is:

1. A system, comprising:
a pallet with one or more printed images;
wherein the images are printed on at least one deck of the pallet;
wherein the deck is a load deck that forms a face where items are carried;
wherein the load deck has a contiguous flat surface where the images are located;
a spacer structure connected to the load deck, wherein the spacer structure defines one or more fork openings;
a support deck attached to the spacer structure, wherein the support deck is located opposite the load deck, wherein the support deck defines one or more jack openings; and
wherein the images are formed by ink directly coating the load deck.

2. The system of claim 1, wherein the deck includes medium density fiberboard (MDF).

3. The system of claim 1, wherein the deck has a sand finish.

4. The system of claim 1, wherein the deck has a matte finish.

5. The system of claim 1, wherein the deck has a vinyl finish.

6. The system of claim 1, wherein the deck includes a load deck.

7. The system of claim 1, further comprising:
a flatbed printer, wherein the images are printed with the flatbed printer.

8. The system of claim 7, wherein the printer has a printer head spaced to accommodate the thickness of the deck.

9. The system of claim 1, further comprising:
a latex printer, wherein the images are printed via the latex printer.

10. The system of claim 1, further comprising:
an ultraviolet (UV) printer, wherein the images are printed via the UV printer.

11. The system of claim 1, wherein the images include advertisements.

12. The system of claim 1, wherein the images include text.

13. The system of claim 12, wherein the text includes quotes.

14. The system of claim 12, wherein the text includes instructions.

15. The system of claim 1, wherein the images include decorations.

16. The system of claim 1, wherein the images include a packing template for at least one packing layer of the pallet.

17. The system of claim 1, wherein:
the load deck has a thickness to be received in a flatbed printer where the images are directly printed on the load deck; and
the load deck is configured to attach to the spacer structure after the images are printed by the flatbed printer.

18. The system of claim 1, wherein the images are photorealistic color images.

19. A system, comprising:
a pallet with one or more printed images;
wherein images are printed on at least one deck of the pallet;

wherein the deck is a load deck that forms a face where items are carried;

wherein the images include a packing template for at least one packing layer of the pallet;

wherein the packing layer is stacked on the load deck; and wherein the images are formed by ink directly coating the load deck.

20. The system of claim 19, wherein the images are printed on at least one deck of the pallet.

21. The system of claim 20, wherein the deck has a contiguous flat surface.

22. The system of claim 20, wherein the deck includes a load deck.

23. The system of claim 20, wherein:

the images include text; and the text includes instructions.

24. A method, comprising:

printing one or more images on a pallet;

wherein said printing includes printing the images with a flatbed printer;

wherein said printing includes printing ink directly onto a load deck of the pallet;

wherein the load deck has a contiguous flat surface where items are carried;

wherein said printing includes printing the ink onto the contiguous flat surface;

wherein the printer has a printer head spaced to accommodate the thickness of the deck; and attaching the load deck to a spacer structure after said printing.

25. The method of claim 24, wherein said printing includes printing the images on at least one deck of the pallet.

26. The method of claim 25, wherein the deck has a contiguous flat surface.

27. The method of claim 26, wherein the deck includes a load deck.

28. The method of claim 25, further comprising:

spacing a printer head of the printer to accommodate the thickness of the deck.

29. The method of claim 25, further comprising:

assembling the deck with a spacer structure of the pallet after said printing.

30. The method of claim 24, wherein said printing includes printing the images via a latex printer.

31. The method of claim 24, wherein said printing includes printing the images via an ultraviolet (UV) printer.

32. The method of claim 24, further comprising:

wherein the printer is an ultraviolet (UV) printer; and attaching a support deck to the spacer structure opposite the load deck.

33. The system of claim 19, wherein the images are photorealistic color images.

* * * * *